US006062231A

United States Patent [19]

De Laforcade

[11] Patent Number: 6,062,231

[45] Date of Patent: May 16, 2000

[54] DEVICE FOR APPLYING A HAIR PRODUCT TO TRESSES

[75] Inventor: Vincent De Laforcade, Rambouillet, France

[73] Assignee: L'Oreal, Paris, France

[21] Appl. No.: 09/088,997

[22] Filed: Jun. 2, 1998

[30] Foreign Application Priority Data

Jun. 12, 1997 [FR] France ..... 97 07297

[51] Int. Cl.[7] ..... A45C 19/00

[52] U.S. Cl. ..... 132/145; 132/208; 132/120; 132/108

[58] Field of Search ..... 132/108, 120, 132/132, 133, 145, 150, 161, 109, 110, 208

[56] References Cited

U.S. PATENT DOCUMENTS

| | | | |
|---|---|---|---|
| 2,000,456 | 5/1935 | Schifter | 132/150 |
| 2,299,296 | 10/1942 | Battle | 132/108 |
| 2,463,611 | 3/1949 | Green et al. . | |
| 2,608,976 | 9/1952 | Kittle et al. | 132/150 |
| 2,705,499 | 4/1955 | Breeze . | |
| 2,761,459 | 9/1956 | Kaul | 132/109 |
| 3,030,968 | 4/1962 | Oberstar et al. . | |
| 5,146,936 | 9/1992 | Ng | 132/208 |
| 5,301,695 | 4/1994 | Wong | 132/108 |
| 5,437,293 | 8/1995 | Colon et al. | 132/120 |

FOREIGN PATENT DOCUMENTS

| | | | |
|---|---|---|---|
| 145779 | 6/1954 | Sweden | 132/108 |

*Primary Examiner*—Todd E. Manahan
*Attorney, Agent, or Firm*—Oblon, Spivak, McClelland, Maier & Neustadt, P.C.

[57] ABSTRACT

A device (1) for applying a hair product to tresses includes a tip (12) for separating a given tress (21) of a head of hair, rows of teeth (5) capable of being charged with a hair product, the application of the hair product to the separated tress being effected by bringing the tress into application contact at a given point of the tress with the teeth (5) and by displacing the teeth (5) relative to the tress from the given point towards the free end of the tress. A part (3, 13) of the device 1 keeps the tress in application contact with the teeth (5) during the whole of the displacement.

20 Claims, 6 Drawing Sheets

DEVICE FOR APPLYING A HAIR PRODUCT TO TRESSES

BACKGROUND OF THE INVENTION

1. Field of the Invention

The present invention relates to a device for applying a hair product to tresses. The invention is especially suitable for applying a tress coloring product.

2. Description of the Related Art

There exist several coloring products for the hair, i.e., those for temporary coloring, semipermanent coloring and permanent coloring, termed oxidation coloring. All these coloring products may take the form of a cream, a mousse, or a liquid with a higher or lower viscosity. The coloring products in the form of a liquid or gel can be used, optionally after mixing, from a "hot bottle" or from a bowl.

Typically, the colorations used from a bowl are intended either for overall use, termed "whole head" use, wherein the head of hair is entirely impregnated with the product with a view to modifying the color of the whole head, or a more partial use, termed "in tresses", where only certain portions of the head of hair are steeped with the product so as to obtain a nonhomogenous color effect once the treatment has been completed, thus emphasizing a given movement of the head of hair, with brighter or darker color nuances than the natural or overall shade of the head of hair; these are often referred to as "highlights" and "lowlights".

According to a first known technique for obtaining such an application in tresses, a "tress cap" is used which tightly covers the head of hair. The tresses to be colored are taken out of the cap through holes regularly distributed over the surface of the cap by means of a hook-type device. The application of the coloring product to the tresses thus extracted is done in the same way as that used for "whole head" coloring. The application of the product is generally undertaken by means of a brush. After the treatment has been completed, the tress cap is removed and the colored hair falls back into its natural position.

The tress cap technique is particularly tedious and has, moreover, three major drawbacks First, after the cap has been positioned, the hair is flattened and the tresses extracted through the openings are extracted at random, which may lead, in particular in terms of the distribution of the tresses, to a result which is substantially different from the result intended. Moreover, the size of the extracted tresses is proportional to the diameter of the openings of the cap. Since this diameter is generally small (typically of the order of 1 mm to 2 mm) the result is a poor juxtaposition of the tresses. Finally, due to the thickness of the cap and the thickness of the tresses, and the fact that the hairs extracted are not necessarily those whose implantation on the scalp are opposite the opening through which they are extracted, it has been found that the coloring product deposited by this technique does not go as far as the roots of the hair, which is detrimental to the natural aspect of the result.

To remedy these deficiencies, a certain number of application devices have been devised. In general, these application devices are based on either a comb or a brush, or a combination of the two. Such devices are described, for example, in U.S. Pat. Nos. 5,146,936 and 4,691,720. Such devices suffer in general from the same drawbacks, linked in particular to the fact that they are used by acting on the head of hair from its outer side, that is to say at its top. The product is primarily deposited on the surface of the tress, and but little on the inside, the applicator being subsequently displaced relative to the tress from the root as far as the tip. Experience shows that the user tends to raise the applicator during this movement and to cause it to deviate from a path parallel to the curvature of the skull. Because of this movement, a certain number of the hairs are detached from the applicator, to fall back onto the head of hair. In the case of a coloring product, these hairs will therefore not be colored. The result obtained is therefore far from satisfactory.

Another type of tress-type applicator is described in U.S. Pat. No. 4,942,893. With this type of applicator, the portion of the head of hair to be colored is introduced into a leakproof capsule containing the coloring product. The tress or tresses are kept in the capsule during the whole time necessary for the action of the coloring product. This type of applicator is well suited for applying the product requiring a certain setting time, but is not at all suitable for the coloring in tresses as set out above.

Tress coloring devices are also known from U.S. Pat. Nos. 3,030,968; 2,705,499 and 2,463,611. All these devices suffer from a major drawback linked to the complexity of their use. Indeed, with all these devices, it is necessary to take the tress up manually or with an appropriate auxiliary tool and to position it on the application element. Apart from the tedious nature of these operations, it is very difficult to apply the product starting at the root of the hair.

SUMMARY OF THE INVENTION

Thus, it is one of the objects of the invention is to provide a device for applying a hair product to tresses, which does not have the drawbacks discussed above.

It is a further object of the invention to provide a device permitting the application of a hair product, which is easy to use and which allows the product to be applied over the whole length of the tress from its root to its free end.

It is another object of the invention to provide a device allowing a tressed hair style to be obtained, the tresses whereof can extend from the root to the tip, whose width remains natural and whose position emphasizes with grace and elegance a given movement of the head of hair, or feature of the face.

In accordance with a feature of the invention, these and other objects are attained by a device for applying a hair product to tresses, comprising application means capable of being charged with a hair product, the application of the hair product to the separated tress being effected by bringing a given point of the tress into application contact with the application means and by displacing the application means relative to the tress from said point in the direction towards the free end of the tress. Retaining means are provided for keeping the tress in application contact with the application means during the whole of said displacement. Means are provided for separating the tress from the rest of the head of hair before the treatment of a given tress, and for positioning it appropriately relative to the application means. Preferably said given point is situated as close as possible to the root of the tress, so as to impart to it as much of a natural aspect as possible. Thus with a single movement, without having to handle the tress with her fingers, the user takes up a precise tress which may be as small as possible, and positions it automatically opposite the application means. The movement is simple, precise and makes it possible to obtain the desired coloration in tresses.

Moreover, while permitting a relative movement between the tress and the application means (substantially along the axis of the tress), the retaining device substantially prevents any movement (perpendicularly to the axis of the tress), which would lead to breaking the contact between the application means and the whole or part of the tress which has been separated. Thus held, the tress cannot be separated from the application means before these means have arrived at the tip of the tress.

According to a preferred embodiment, the device has a longitudinal axis and comprises a first part, a first end whereof carries the application means, the retaining means being formed by a second part articulated to the first part around an articulation means situated in the vicinity of the second end of the first part and perpendicular to the longitudinal axis of the device, so as to be capable of being folded onto the second, the second part having receiving means to come into engagement with the application means in the folded position, and to keep the tress in an application contact with the application means during the displacement of the application means relative to the tress when the latter is disposed between the first part and the second part. With such a configuration, the tress is "pinched" between two parts of the device without being held too tightly, so as to permit the device to slide along the tress from its root as far as its tip.

Advantageously, the means for separating the tress from the rest of the head of hair before the treatment of a given tress, and positioning it appropriately relative to the application means comprise a pointed element formed by the free end of the second part and disposed adjacent to the receiving means, and means forming an axial stop disposed adjacent to the receiving means on the opposite side to the pointed element. The point is used in the manner of a "comb tail" for selecting a given tress. The means forming the axial stop pi event the tress taken up from sliding axially in the direction towards the articulation zone of the two parts, and thus allows the tress taken up to be held in position opposite the application means. Such a concept permits a particularly simple design that can be obtained very economically by conventional molding techniques not requiring the use of expensive molds.

According to a preferred embodiment, the first part is articulated relative to the second so as to be capable of forming between them an angle greater than or equal to approximately 90° in the maximum opening position, means being provided so as to immobilize the first part in a reversible manner relative to the second in an intermediate position, by forming an angle of less than 90°. Still more preferentially, the maximum opening angle is greater than or equal to approximately 180°, the opening angle of the intermediate position being from 20 to 70°. Thus in the maximum opening position, the application element, disposed at approximately 180° relative to the second part, can be immersed in a bowl containing the composition to be applied. Taking up the tress to be treated is then effected by placing the device into an intermediate position, which greatly facilitates its handling. Typically, the angle of the intermediate position is approximately 45°.

Advantageously, the device comprises elastic means (capable of straining an element carried by one of the first or second parts in an abutment mode against a zone of an elastically deformable element carried by the other of the first or second parts, so as to immobilize the first part in a reversible manner relative to the second in the intermediate position. This embodiment makes it possible to immobilize the device in the intermediate position in a simple manner, substantially without any additional expense or addition of extra parts.

The application means may comprise at least one row of teeth aligned parallel to the longitudinal axis of the device. The teeth may be aligned or disposed in a staggered arrangement or irregularly, depending on the applications to be obtained.

According to a possible embodiment, the application means comprise tufts of bristles apart from the teeth. The tufts of bristles may be disposed in alternation with the teeth, the bristles being of a length shorter than the length of the teeth. Such tufts of bristles serve to retain the product and to spread it more evenly over the whole length of the treated tress. Alternatively, the tufts of bristles are arranged in the form of at least one row parallel to the row (or rows) of teeth. According to another variant, the tufts of bristles are disposed at random around the teeth. According to still another variant, the application means are comprised essentially of bristles, such as a mascara brush of the type formed of an array of radially extending bristles mounted on a central core, especially one made of metal.

Advantageously, the application means are disposed in two parallel rows situated on either side of the longitudinal axis of the device, the receiving means intended to come into engagement with the application means being formed by a portion of the second part, whose width perpendicular to the longitudinal axis of the device is slightly smaller than the distance separating the two rows, so that in the folded-down position of the second part onto the first, said portion is engaged between the two rows over a given height.

The device may comprise a stop to limit the engagement height of said portion between the two rows of the application means. This characteristic makes it possible to prevent the tress from being held too tightly between the two parts of the device.

Alternatively, the application means are disposed in one row aligned on the longitudinal axis of the device, the receiving means intended to come into engagement with the application means being formed by an axial groove arranged on a surface of the second part opposite the application means, and intended to receive the free end of the teeth.

Positioning means may be provided between the application means and the articulation means, so as to facilitate the engagement of the application means and of the receiving means. Such means participate in guiding the folding movement of the second part onto the first, and prevent any angular deviation (or torsion) of one of the parts relative to the other, which deviation would inevitably lead to the wrong positioning of the application means relative to the receiving means. This is particularly advantageous when the hinge connecting the two parts is a film hinge.

By way of example, the positioning means may comprise a boss provided on one of the first or second parts, and intended to come into engagement with a corresponding cutout provided on the other of the first or second parts when the second part is in its folded-down position on the first.

Advantageously, the device is obtained by molding at east one thermoplastic material chosen from polyethylenes, polypropylenes, polystyrenes, polyvinyl chlorides, polyethylene terephthalates etc. Other materials may be used in accordance with the invention. Such a device may be molded in a single piece, advantageously without any undercut. It can therefore be manufactured at a cost price which is perfectly in line with its use in coloring kits sold in large numbers.

The hair product may be a coloring product. Alternatively, it may be a cream or a treatment product.

BRIEF DESCRIPTION OF THE DRAWINGS

Apart from the arrangements set out above, the invention consists of a certain number of other arrangements which will be explained below with regard to nonrestrictive embodiments described, by way of example, with reference to the attached Figures, wherein.

DETAILED DESCRIPTION OF THE PREFERRED EMBODIMENTS

Figure 1:
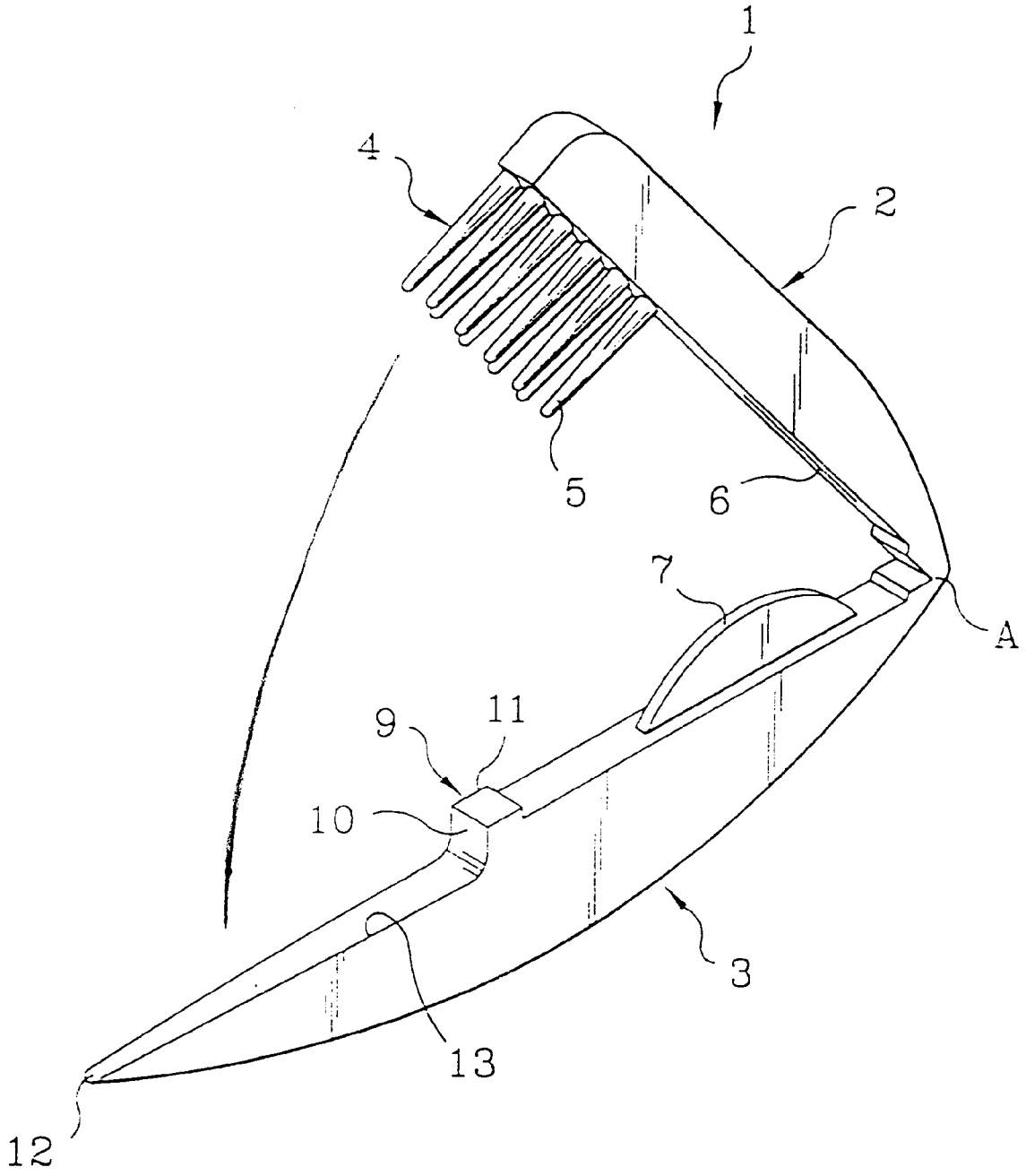
FIG. 1 shows a view in perspective of a first embodiment of the device in accordance with the invention.

FIGS. 1 and 2A–2C, to which reference will now be made, illustrate different views of a first embodiment of the device 1 in accordance with the invention. This device 1 is composed of first and second tong-like parts 2, 3, the first part 2 carrying two rows of teeth 5 forming an application means 4, the second part 3 being articulated to the first (around an articulation A) so as to be folded onto the first part and to trap the tress to be treated, so as to keep it in application contact with the application means 4. Advantageously, the device is obtained by molding a thermoplastic material such as polyethylene or polypropylene in a single piece. The articulation A is constituted by a film hinge.

Figure 2A:
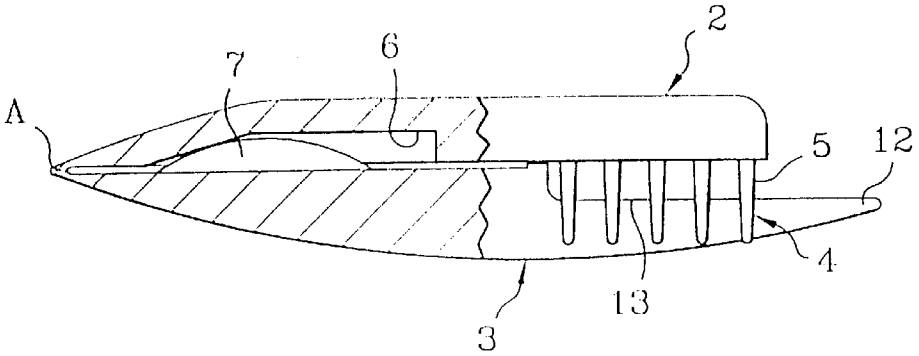
FIGS. 2A–2C illustrate other views of the device shown in perspective in FIG. 1.
Figure 2B:
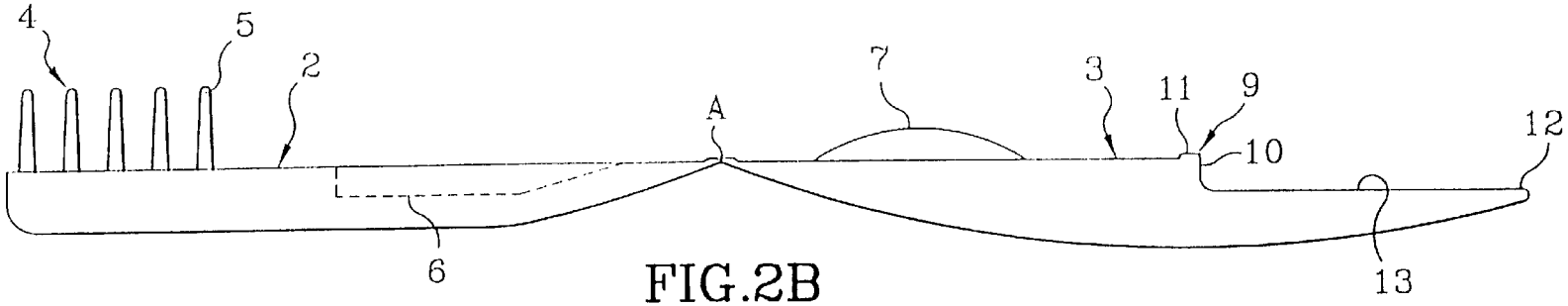
Figure 2C:
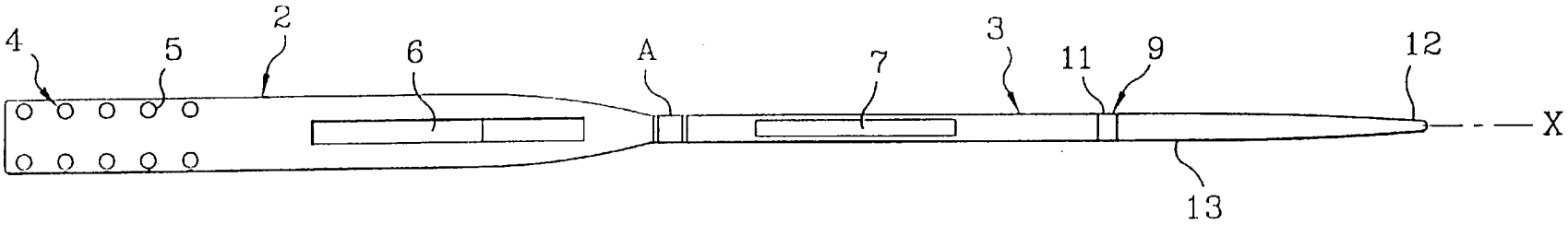

As shown in the open position in FIGS. 2B and 2C, the device has an longitudinal central axis X. The application means 4 are disposed on the free end of the first part 2 and are formed by two rows of teeth 5, the rows being situated on either side of the axis X and extending parallel to the said axis. The teeth have a length of from 5 mm to 20 mm and preferably from 10 mm to 15 mm. Between the application means 4 and the articulation A, there is provided a reinforcement or guide groove 6 capable of receiving a convex boss 7 provided on a corresponding portion of the second part 3. Thus when passing from the open position to the closed position shown in FIG. 2A, the boss 7 enters into the groove 6, thus guiding the folding movement of the second part 3 onto the first part 2. This ensures proper positioning of the application means 4 relative to the corresponding receiving means provided on the second part 3.

The part 3 has, at least at its receiving means 13 intended to come opposite the application means, a width that is slightly less than the spacing between the two rows of teeth 5, so that by folding the first part 2 onto the second part 3, the receiving means 13 opposite the teeth 5 engages between the rows of the teeth 5, thus allowing a tress of hair to be enclosed between the parts 2, 3 of the device. This receiving means 13 is capable of keeping the tress in application contact with the teeth 5 of the device.

A shoulder 10 and a stop 11 define means 9 disposed adjacent to the receiving means 13 and between the receiving means and the boss 7. The means 9 ensure a two-fold function. On the one hand, the shoulder 10 is capable of preventing a tress, taken up in a way described in greater detail below, from sliding in the direction towards the articulation or film hinge A. On the other hand, the stop 11 or half-flat is capable of limiting the engagement of the receiving means 13 between the rows of teeth 5. Typically, this stop 11 is arranged so as to permit an engagement depth of the order of 5 to 10 mm, thus leaving a free height between the teeth of the order of 5 to 7 mm. This height is sufficient to allow the device to slide along the tress when it is disposed between the teeth 5 of the device 1, as will be seen in greater detail with reference to FIGS. 3A to 3D.

In the embodiment illustrated in FIGS. 2A to 2C, the second part 3 has an axial length greater than the axial length of the first part 2. Thus, the free end of the second part 3 forms a tip 12 which will be used in the manner of a "comb tail" for taking up a tress and positioning it appropriately relative to the application means 4 and the receiving means 13.

In using this device, as shown in FIGS. 3A–3D having prepared a coloring composition (P) (in a bowl 20 for example), the consumer grips the applicator device 1 at the second part 3, keeping the applicator unfolded. She dips the application means 4 into the composition P (FIG. 3A) so that a quantity of the mixture sufficient for one tress is held between and around the teeth 5. The liquid adheres essentially by surface tension or capillarity effect. A greater viscosity of the composition promotes its hold by the application means. The teeth may be subjected to processing (by a corona effect or chemically, for example) so as to modify their surface state and to promote the adherence of the product to the application means, as well as its conveyance with a view to application. Striation-type reliefs, or grooves may also be provided for this purpose on the teeth 5 of the application means.

Subsequently, the consumer selects the tress 21 which she wishes to treat by using the tip 12 (FIG. 3B) like the end of a end comb, which permits very high precision in the choice and selection of the tress in its width and depth. The stop 9 prevents the selected tress from sliding further forward towards the hinge A, thus keeping it opposite the receiving means 13.

Thereafter, the consumer closes the applicator device 1 onto itself (FIG. 3*c*) by causing it to pivot around the axis defined by the film hinge A. In the closed position, the boss 7 penetrates into the guide groove 6 to prevent angular deviation of the respective axes of the parts 2 and 3, thus allowing the rows of teeth 5 to be positioned accurately on either side of the receiving means 13. The tress 21 is thus trapped in the space defined by the surface supporting the teeth 5, the surface opposite the teeth 5 themselves. The selected tress 21 is then "steeped" at its root by the coloring product (P).

Figure 3A:
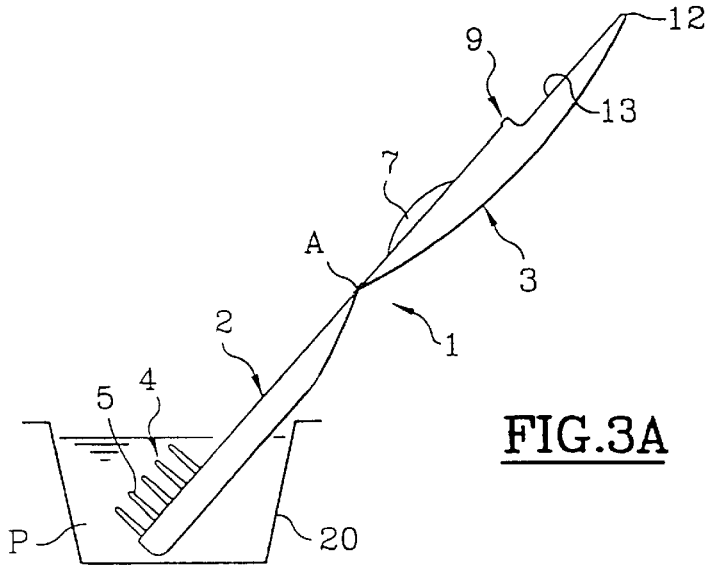
FIGS. 3A–3D illustrate the functioning of the device illustrated in FIGS. 1 and 2A–2C.
Figure 3B:
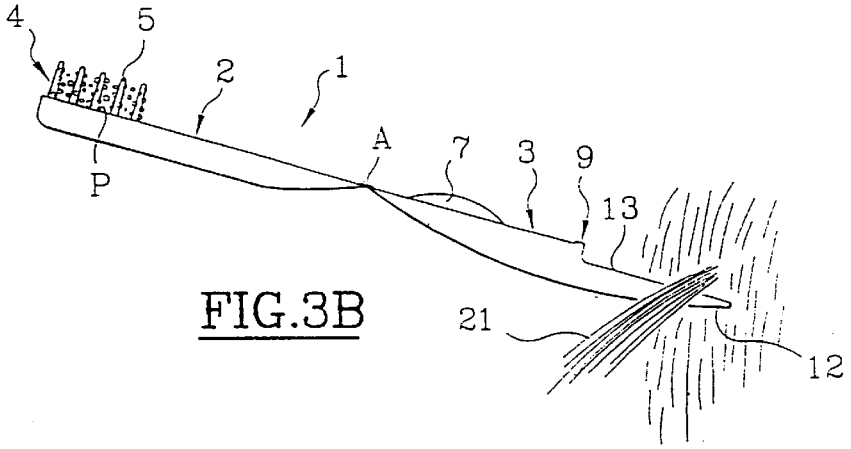
Figure 3C:
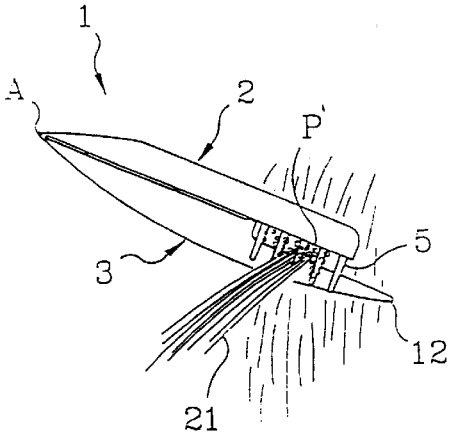
Figure 3D:
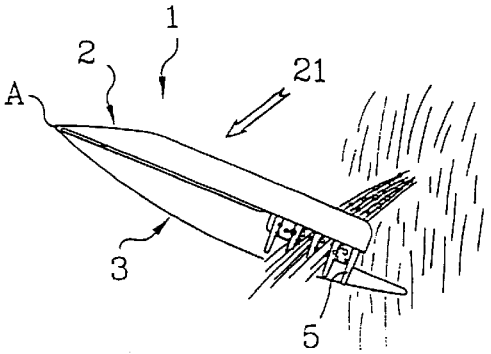

According to another mode of using the device 1 in this embodiment, the user partly closes the device (so as to have the first part 2 forming an angle of approximately 45°, for example, with the second part 3), and takes up the tress in this partly folded position, which facilitates handling with only one hand. She subsequently completely closes the device to apply the product to the selected tress. It then suffices to cause the applicator device 1 to slide in its closed position through the teeth 5 towards the tip of the tress 21 in the direction of the arrow to impregnate it in depth and evenly from the root to the tip (FIG. 3D). This process is repeated as often as desired.

Thus with the application device in accordance with the invention, the treated tress 21 is completely controlled and held during the whole of its treatment. At the end of the movement, that is, when the applicator arrives at the tip of the tress, it is carefully repositioned on the head. In the case of a coloring product, its viscosity is such that the product will not appreciably migrate towards the other untreated hair, so as not to impair the aesthetic appearance of the application thus obtained.

Figure 4A:
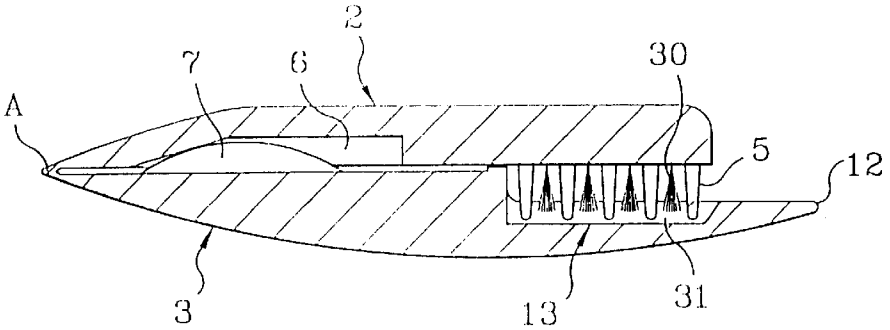
FIGS. 4A–4C illustrate a second embodiment of the device in accordance with the invention.
Figure 4B:
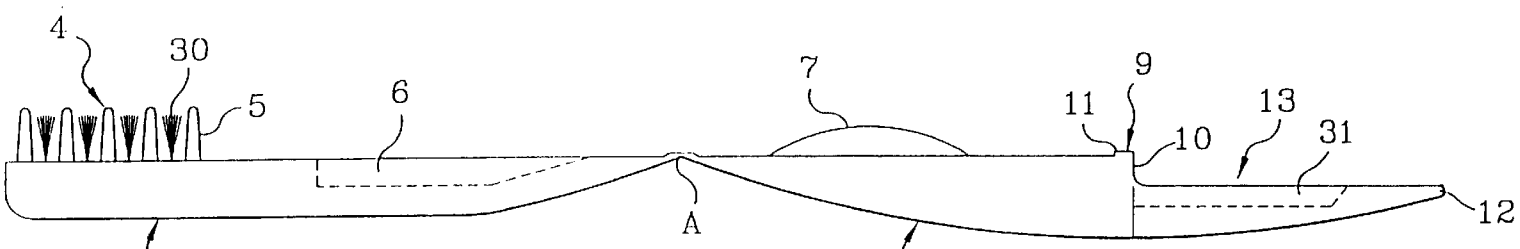
Figure 4C:
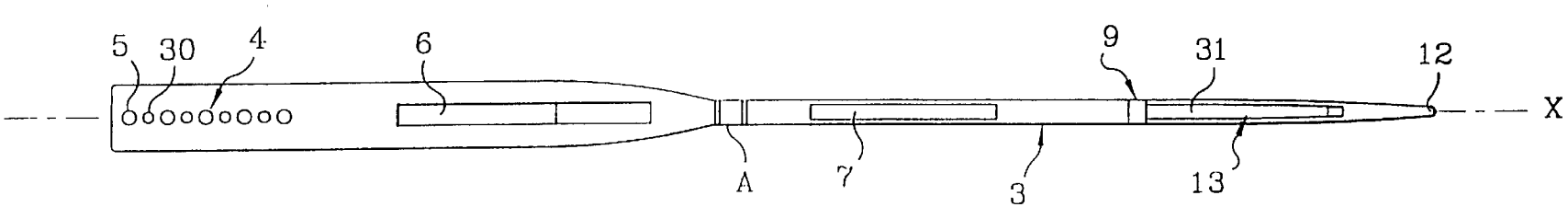

The embodiment of FIGS. 4A to 4C differs from that of the FIGS. 1–3D discussed above in that the application means 4 are formed by a single row of teeth 5 which is centered on the axis X of the device 1. Two adjacent teeth are separated by a tuft of bristles 30 whose length is preferably slightly less than the length of the teeth 5 which surround it. By way of example, for teeth whose length may be of the order of 9 to 10 mm, the length of the bristles is of the order of 7 to 8 mm. The function of the tufts of bristles is to retain the product and to spread it more evenly over the whole length of the treated tress. They progressively release the product which they convey, ensuring a uniform deposit of the product over the whole length of the tress. As indicated above, the tufts of bristles may be disposed differently relative to the teeth. Moreover, such tufts of bristles can also be used in the preceding embodiment with two rows of teeth.

The receiving means 13 are formed by a cutout shaped in the form of a groove 31 (centered on the central axis X) arranged so as to receive the free ends of the teeth 5, and optionally the tufts of bristles 30 disposed between the teeth 5. By way of illustration, the groove may have a depth of from 2 mm to 5 mm. The rest of the device, as well as its functioning, are identical with that described with reference to the preceding Figures.

Figure 5:
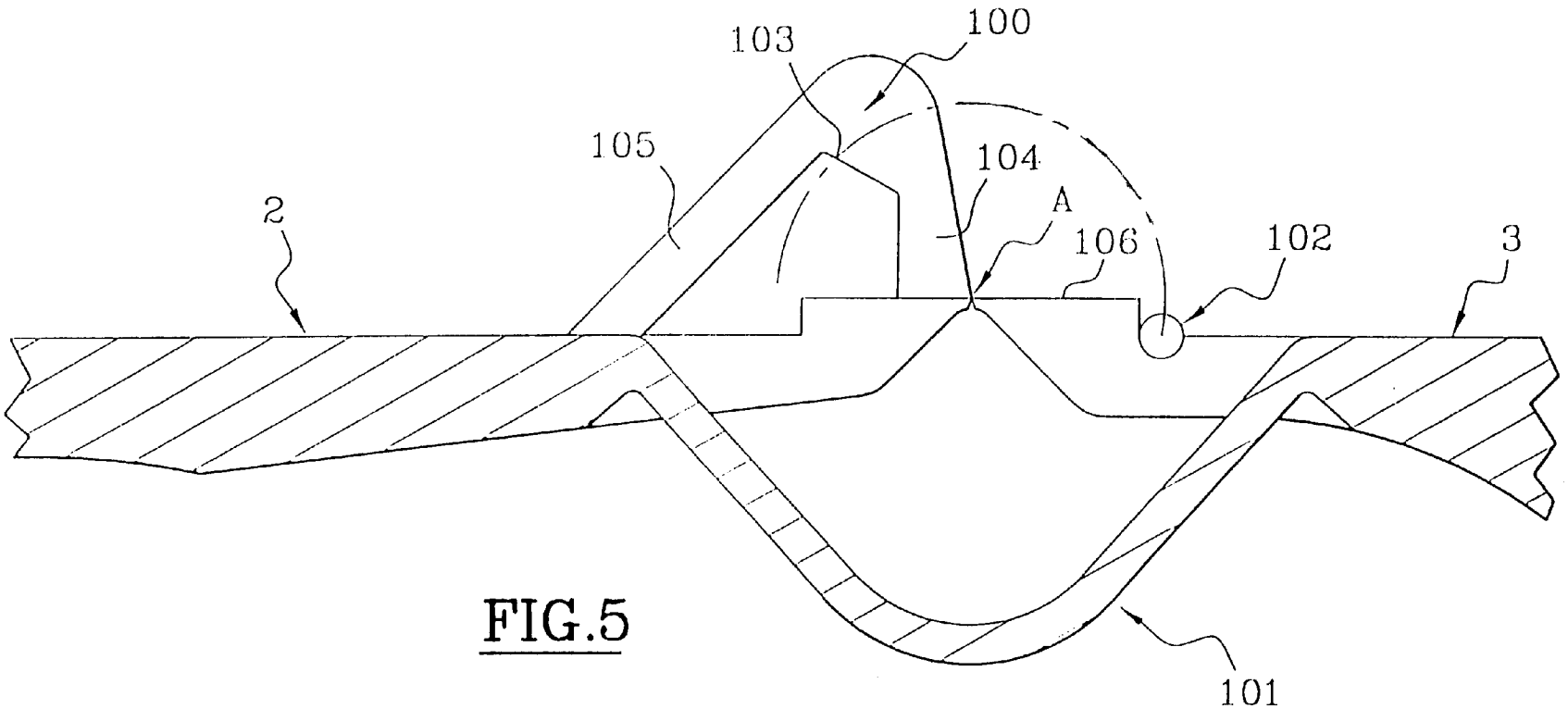
FIG. 5 illustrates a preferred articulation used in an embodiment of the invention.

FIG. 5, to which reference will now be made, illustrates a preferred articulation A between the first part 2 carrying the application means 4 (not shown) and the second part 3 carrying the receiving means 13 (not shown) intended to be positioned opposite the application means. According to this embodiment, the articulation A is formed by a central connecting strip 101 which, in the 180° open position of the device, substantially forms a rounded V, a first end thereof being joined to the first part 2 and the other end being joined to the second part 3.

The articulation A also has two side strips 106 situated on either side of the central connecting strip 101. Each of the side strips 106 has a zone of lesser thickness defining the film hinge forming the articulation A. The first part 2 also has two V-shaped portions 100 connected to the side strips 106 and inverted relative to the V formed by the central connecting strip 101. One arm 104 of each portion 100 is substantially perpendicular to the longitudinal axis of the first part 2, and the other arm 105 is oriented substantially at 45° relative to the first arm 104.

The portions 100 are disposed on the external edges of the first part 2 in the vicinity of the articulation A. The second part 3 carries two studs 102 projecting towards the outside. The studs 102 cross the path of the arms 104 at an intermediate point during the movement of folding the first part 2 onto the second part 3, but allow further closing due to the elastic deformation of the arms 104. Thus, the studs 102 become positioned at a stop 103 inside the V formed by the parts 100 and may be held there by the central connecting strip 101 which is elastically strained during the closure. This straining creates an intermediate open position at approximately 45° of the opening movement, which greatly facilitates the manipulation of the device when taking up a given tress for treatment. To close the device completely for applying the product to the tresses, it suffices to exert further pressure on the first part 2. During the opening of the device for taking up a new product dose, the studs 102 again elastically deform the arms 104.

Figure 6:
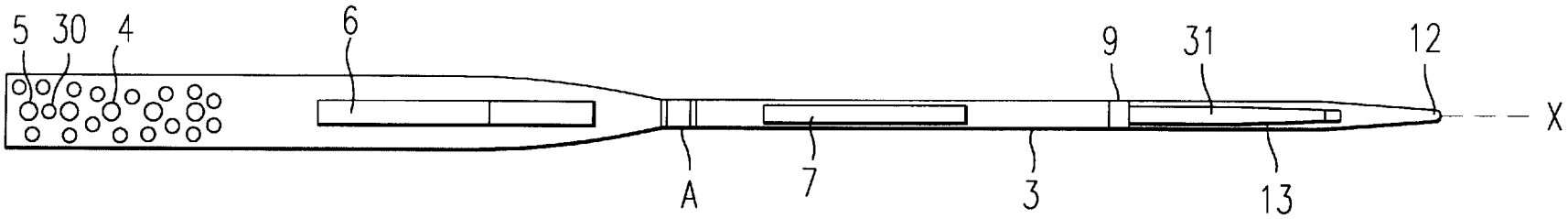
FIG. 6 illustrates a third embodiment of the device in accordance with the invention.

The embodiment of FIG. 6 differs from that of FIG. 4C discussed above in that the tufts of bristles 30 are disposed at random around the teeth on the application means 4.

In the preceding detailed description, reference has been made to several preferred embodiments of the invention. It is obvious that variants can be introduced without thereby departing from the scope of the invention, as claimed below.

What is claimed is:

1. A device for applying a hair product to tresses, comprising:

an application member configured to a hair product to a tress by bringing a portion of the tress into application contact with said application member, said application member being displaceable relative to the tress in a direction towards a free end of the tress;

a retaining element mounted relative to said application member so as to come into retaining engagement with said application member, said retaining element being configured to keep the tress in application contact with the application member during displacement;

a separating element arranged adjacent said retaining element and configured to separate the tress from a remainder of the hair before treatment of the tress, said separating element being positioned on a first side of said remaining element; and a positioning member arranged adjacent said retaining element and in cooperation with said separating element, configured to ensure automatically a proper positioning of the separated tress relative to said application member, said positioning member being arranged on a second side of said retaining element, opposite to said first side.

2. A device according to claim 1, including a first part carrying the application member, a second part carrying the retaining element, and an articulation located between the first part and the second part, wherein said retaining element comes into engagement with the application member in a folded position of the first and second parts.

3. A device according to claim 2, wherein the retaining element is pivotally mounted relative to the application member around the articulation.

4. A device according to claim 1, wherein the positioning member properly positions said separated tress relative to the retaining element prior to coming into retaining engagement with the application member.

5. A device for applying a hair product to tresses comprising:

application means for applying a hair product to a tress, said application means being displaceable relative to the tress in a direction towards a free end of the tress;

retaining means for keeping the tress in application contact with the application means during displacement;

means for separating the tress from a remainder of the hair before treatment of the tress, and for positioning the tress relative to said application means;

a first part having a first end carrying the application means;

a second part carrying the retaining means and being articulated to the first part around an articulation perpendicular to a longitudinal axis of the first part said articulation being located adjacent a second end of the first part;

wherein said retaining means comes into engagement with the application means in a folded position of the first and second parts; and wherein said means for separating the tress includes a pointed element disposed adjacent to the retaining means, and also includes means for forming a rotational stop adjacent to a portion of the retaining means opposite to the pointed element.

6. A device according to claim 5, wherein the application means includes at least one row of teeth aligned parallel to the longitudinal axis thereof.

7. A device according to claim 6, wherein the application means comprise tufts of bristles.

8. A device according to claim 7, wherein the tufts of bristles are disposed in at least one row parallel to the rows of teeth.

9. A device according to claim 7, wherein the tufts of bristles are disposed in alternation with said teeth, the bristles having a length shorter than the length of the teeth.

10. A device according to claim 7, wherein the tufts of bristles are disposed at random around said teeth.

11. A device according to claim 6, wherein the application means are disposed in two parallel rows situated on either side of the longitudinal axis, wherein the retaining means are formed with a width perpendicular to the longitudinal axis and said width is smaller than a distance separating the two rows, so that, in the folded-down position, the retaining means is engaged between the two rows.

12. A device according to claim 11, wherein said means for forming a rotational stop limits an engagement height of the retaining means between the two rows of the application means.

13. A device according to claim 6, wherein the application means is disposed in one row aligned on the longitudinal axis, wherein the retaining means is formed by an axial groove arranged on a surface opposite the application means and is positioned to receive a free end of the teeth.

14. A device for applying a hair product to tresses, comprising:

application means for applying a hair product to a tress, said application means being displaceable relative to the tress in a direction towards a free end of the tress;

retaining means for keeping the tress in application contact with the application means during displacement;

means for separating the tress from a remainder of the hair before treatment of the tress, and for positioning the tress relative to said application means;

a first part having a first end carrying the applications means;

a second part carrying the retaining means and being articulated to the first part around an articulation perpendicular to a longitudinal axis of the first part, said articulation being, located adjacent a second end of the first part;

wherein said retaining means comes into engagement with the application means in a folded position of the first and second parts; and positioning means provided between the application means and the articulation for facilitating engagement of the application means and the retaining means.

15. A device according to claim 14, wherein said positioning means comprise a boss provided on one of said first and second parts, and a corresponding cutout provided on the other of said first and second parts and positioned to be in engagement with the boss when the second part is in the folded position.

16. A device according to claim 14, formed of a molded thermoplastic material chosen from one of polyethylenes, polypropylenes, polystyrenes, polyvinyl chlorides and polyethylene terephthalates.

17. A device according to the claim 16, wherein the articulation is formed by a film hinge.

18. A device for applying a hair product to tresses, comprising:

application means for applying a hair product to a tress ,said application means being displaceable relative to the tress in a direction towards a free end of the tress;

retaining means for keeping the tress in application contact with the application means during displacement;

means for separating the tress from a remainder of the hair before treatment of the tress, and for positioning the tress relative to said application means;

a first part having a first end carrying the application means;

a second part carrying the retaining means and being articulated to the first part around an articulation perpendicular to a longitudinal axis of the first part, said articulation being located adjacent a second end of the first part;

wherein said retaining means comes into engagement with the application means in a folded position of the first and second parts;

wherein the articulation is capable of forming a maximum opening angle greater than about 90° between the first and second parts; and means for immobilizing the first part relative to the second part in an intermediate position of the first and second parts.

19. A device according to claim 18, wherein the maximum opening angle is greater than about 180°, the opening angle of the intermediate position being from 20 to 70°.

20. A device according to claim 18, wherein one of said first and second parts has an elastically deformable element having an immobilizing zone, wherein the other of said first and second parts has an element engageable with the immobilizing zone when the first and second parts are at the intermediate position, and an elastic element which elastically biases the element into engagement with the immobilizing zone.

* * * * *

UNITED STATES PATENT AND TRADEMARK OFFICE

CERTIFICATE OF CORRECTION

PATENT NO. : 6,062,231

DATED : MAY 16, 2000

INVENTOR(S): VINCENT DE LAFORCADE

It is certified that an error appears in the above-identified patent and that said Letters Patent is hereby corrected as shown below:

Col. 3, lines 31 and 32, change "pievent" to --prevent--.

line 57, delete "(";

Col. 4, line 24, after "that", insert a comma;

line 53, change "east" to --least--;

Col. 5, line 38, delete "said";

Col. 6, line 14, after "3D", insert a comma; and line 32, change "end" to --tail--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,062,231
DATED : May 16, 2000
INVENTOR(S) : Vincent De Laforcade

It is certified that error appears in the above-identified patent and that said Letters Patent is hereby corrected as shown below:

Column 8,
Line 8, after “to” (first occurrence) insert -- apply --;
Line 58, after “part” insert -- , --.

Column 9,
Line 48, delete “,”.

Column 10,
Line 16, after “tress” insert -- , --;
Line 17, delete “,”.

Signed and Sealed this

Ninth Day of July, 2002

*Attest:*

*Attesting Officer*

JAMES E. ROGAN
*Director of the United States Patent and Trademark Office*